US005544585A

United States Patent [19]

Duguet

[11] Patent Number: 5,544,585

[45] Date of Patent: Aug. 13, 1996

[54] ELECTRO-PYROTECHNICAL INITIATOR

[75] Inventor: Jean-Rene Duguet, Orry La Ville, France

[73] Assignee: NCS Pyrotechnie et Technologies, Fosses, France

[21] Appl. No.: 237,287

[22] Filed: May 3, 1994

[30] Foreign Application Priority Data

May 5, 1993 [FR] France ..... 93 05370

[51] Int. Cl.[6] ..... F42C 19/12

[52] U.S. Cl. ..... 102/202.5; 102/202.9

[58] Field of Search ..... 102/202.5, 202.9, 102/202.14, 202.7

[56] References Cited

U.S. PATENT DOCUMENTS

| | | | |
|---|---|---|---|
| 3,366,055 | 1/1968 | Hollander, Jr. | 102/28 R |
| 3,447,416 | 6/1969 | Apstein . | |
| 3,779,167 | 12/1973 | Irish, Jr. et al. | 102/202.5 |
| 3,910,188 | 10/1975 | Stevens | 102/202.5 |
| 4,040,356 | 8/1977 | Voreck, Jr. et al. . | |
| 4,312,271 | 1/1982 | Day et al. | 102/202.7 |
| 4,729,315 | 3/1988 | Proffitt et al. | 102/202.9 |
| 4,760,795 | 8/1988 | Young | 102/473 |
| 4,869,170 | 9/1989 | Dahmberg et al. | 102/202.5 |
| 4,924,774 | 5/1990 | Lenzen | 102/202.7 |
| 5,029,529 | 7/1991 | Mandigo et al. . | |
| 5,090,322 | 2/1992 | Allford | 102/202.5 |
| 5,125,335 | 6/1992 | Grommes et al. | 102/202.13 |
| 5,140,906 | 8/1992 | Little, II | 102/202.9 |
| 5,230,287 | 7/1993 | Arrell, Jr. et al. | 102/202.5 |
| 5,394,801 | 3/1995 | Faber et al. | 102/202.7 |

FOREIGN PATENT DOCUMENTS

| | | | |
|---|---|---|---|
| 0510551 | 10/1992 | European Pat. Off. | 102/202.5 |
| 2090579 | 4/1971 | France . | |
| 9419661 | 9/1994 | WIPO | 102/202.15 |

*Primary Examiner*—Michael J. Carone
*Assistant Examiner*—Theresa M. Wesson
*Attorney, Agent, or Firm*—Blakely, Sokoloff, Taylor & Zafman

[57] ABSTRACT

An electro-pyrotechnical initiator comprising a form pyrotechnical charge initiated by a heating resistive element placed in contact with said charge. The resistive element comprises a flat strip of narrow width l, preferably lying in the range 80 micrometers to 300 micrometers, and made of a resistive metal alloy which is deposited on a printed circuit support, said resistive element being connected to two current feeds via two extensive electrically-conductive areas, and the pyrotechnical charge is a thermosensitive substance that is applied in the form of an explosive varnish that covers said resistive element.

10 Claims, 1 Drawing Sheet

ELECTRO-PYROTECHNICAL INITIATOR

The present invention relates to an electro-pyrotechnical initiator comprising a pyrotechnical charge that is initiated by a heating resistive element placed in contact with the charge.

The invention also relates to a method of implementing such an initiator.

BACKGROUND OF THE INVENTION

A particularly advantageous application of the invention lies in igniting the pyrotechnical system of an "air bag" type device, but it may also be applied to missiles or space vehicles, and in general, to any electro-pyrotechnical initiation system that is required to have a high degree of operating regularity and a very high degree of reliability.

At present, one such initiator is known in which the resistive element is a small diameter cylindrical filament constituted by an alloy of high resistivity. The resistive filament is bonded at its respective ends to two current feeds.

In addition, initiators of the prior art include a thermosensitive substance that is in close contact with the resistive element. This substance is in the either of a mass of powder that has been compacted under high pressure, or else in the form of a "bead" type match head obtained by a conventional dipping technique. A very short length of time after electrical current begins to flow through the resistive element, the Joule effect causes the temperature of said thermosensitive substance to rise to its point of rapid self-decomposition, thereby leading to deflagration, and in an igniter said pyrotechnical reaction serves to ignite an auxiliary powder or a reinforcing pyrotechnical composition, or in a detonator it initiates detonation of a primary charge.

However, known initiators as described above suffer from a certain number of drawbacks:

firstly, handling and directly bonding the resistive filament having a diameter of a few tens of microns to the current feeds is always difficult to perform on an industrial scale;

in addition, the resulting initiators have electrical resistances that are rather widely dispersed because of the necessarily inaccurate definition of the working lengths between the bonds of different filaments;

and also, when using a thermosensitive substance in powder form, it can be difficult to achieve and to maintain the necessary close contact with the resistive filament. It is then necessary to use very strong metal rings at very high levels of compression. With a match head obtained by dipping, the shape of the bead and thus its mass are variable. In addition, in an igniter, the reinforcing powder is generally black powder, and to obtain proper igniting, it is necessary to have quite a large mass of thermosensitive substance (about 30 mg), and that requires weighing operations to be integrated in the manufacturing process.

Consequently, prior art initiators generally have a rather wide dispersion of performance characteristics with respect to sensitivity, operating time, and intensity of the resulting pyrotechnical phenomenon. In addition, they can give rise to problems under severe environmental conditions, in particular the shocks and vibrations that may be encountered in the lifetime of the product.

OBJECTS AND SUMMARY OF THE INVENTION

In order to mitigate the drawbacks presented in the prior art, the present invention provides an electro-pyrotechnical initiator in which said resistive element comprises a flat strip of narrow width l, preferably lying in the range 80 micrometers to 300 micrometers, and of length L lying in the range 0.3 mm to 3 mm, the strip being obtained by photoetching a thin film of resistive metal alloy that has a thickness lying in the range 1 μm to 15 μm and that has previously been secured to a printed circuit support, said resistive element being connected to two current feeds via two large electrically-conductive areas, and in which the pyrotechnical charge is a thermosensitive substance applied in the form of an explosive varnish covering the resistive element.

The dimensions of the resistive element, determined by calculation and by a large number of practical tests are achieved with very high accuracy using known techniques of photolithography, and the use of oxidizer-reducer reinforcing compositions instead of black powder ensures that ignition is very reliable, even when using a very small mass of thermosensitive substance in the form of a fine layer of explosive varnish. The method of varnish deposition and inspection are thus made easier in the context of industrial production.

Such an initiator is simple to make by using a printed circuit manufacturing technique that is well known to the person skilled in the art. Its shape may be adapted to the characteristics that are required and it is extremely accurate and reproducible in mass production. In addition, the initiator of the invention includes large electrically-conductive areas that are connected firstly to the ends of the resistive elements and that are easily connected secondly to the current feeds using conventional bonding techniques well known to the person skilled in the art, such as welding, soldering, or crimping.

Thus, according to the invention, the electro-pyrotechnical initiator is robust, insensitive to external attack, and of long lifetime. Its sensitivity characteristics are reliable and its operating time is short and regular, thereby making it suitable for application, for example, to igniters for new-generation air bags.

BRIEF DESCRIPTION OF THE DRAWING

The following description made with reference to the accompanying drawing and given by way of non-limiting illustration makes it easy to understand what the invention consists in and how it can be implemented.

MORE DETAILED DESCRIPTION

Figure 1:
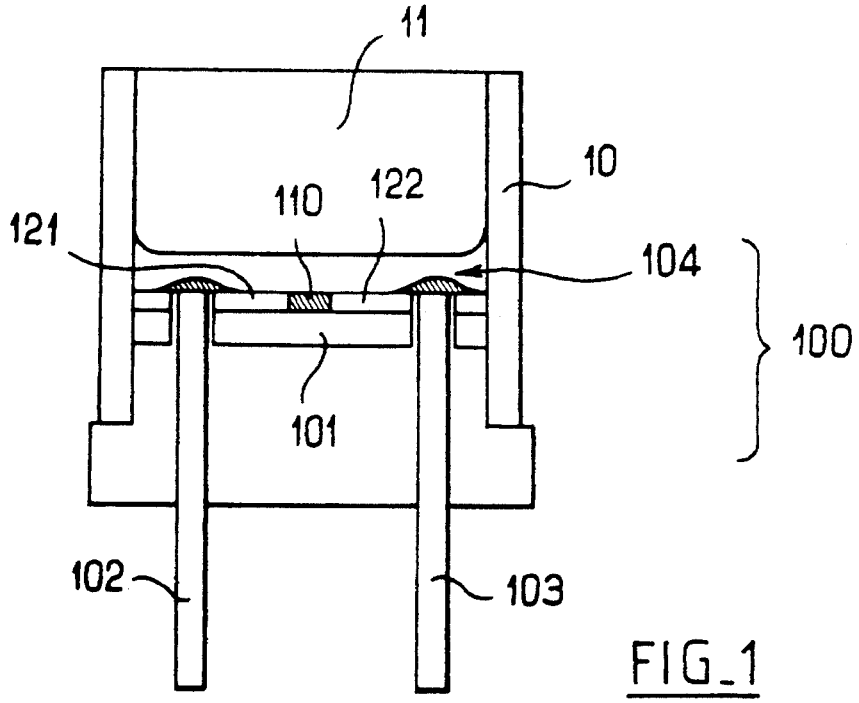
FIG. 1 is a diagrammatic longitudinal section through a system including an initiator of the invention.

FIG. 1 shows an initiator system comprising a cap 10 made of a plastics material or of a metal, and having a tank 11 provided in its top portion. The tank 11 contains a reinforcing composition such as an igniter composition or a powder or a primary explosive. The cap 10 is disposed in secure manner on an electro-pyrotechnical head 100 so that said head 100 is placed immediately below the bottom of the tank 11 in proximity with the reinforcing composition. The head 100 is designed to ignite the reinforcing composition that is placed in the tank 11.

Figure 2:
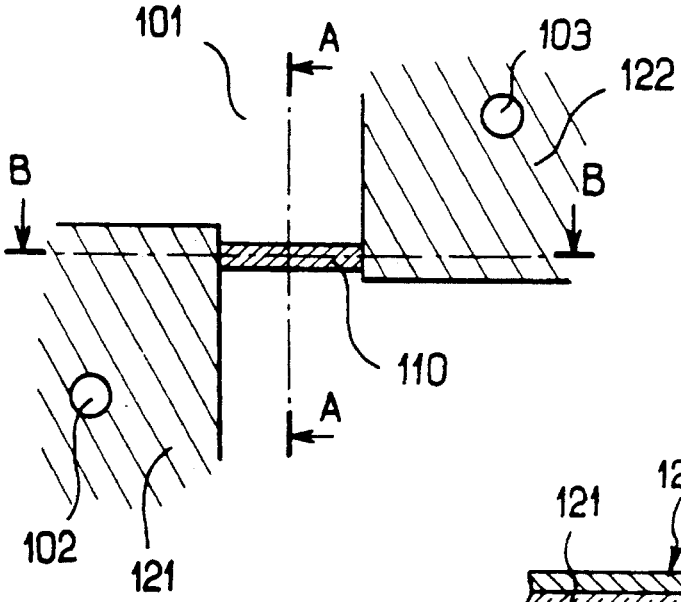
FIG. 2 is a fragmentary diagrammatic plan view of a printed circuit constituting the initiator of the invention.
Figure 3:
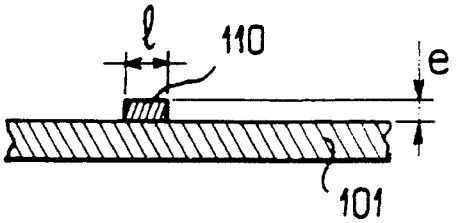
FIG. 3 is a diagrammatic section view on plane A—A through the printed circuit of FIG. 2.
Figure 4:
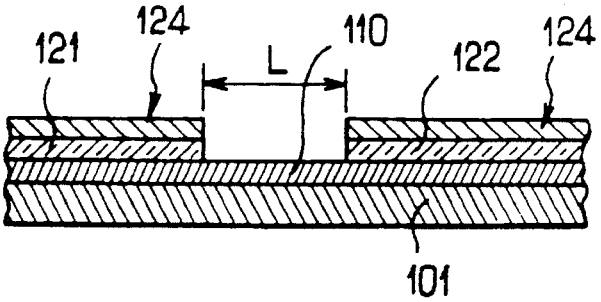
FIG. 4 is a diagrammatic section view on plane B—B through the printed circuit of FIG. 2.

As can be seen in FIG. 1, and more particularly in FIGS. 2, 3, and 4, the electro-pyrotechnical head 100 comprises a printed circuit support 101 placed inside the cap 10. This printed circuit support 101 is implemented in this case using a composite plastics material, such as a fiberglass-filled epoxy resin, for example. In addition, the printed support 101 includes a flat strip 110 on its top surface that faces the bottom of the tank 11. This strip is constituted by a resistive metal alloy and in this case it is in the form of a parallelepiped. In order to enable the absolutely essential accuracy of this flat strip to be ensured in mass production, the strip is made, for example, by using the conventional technique for etching "thin film" printed circuits, which technique consists in photoetching a thin foil of resistive alloy such as nickel-chromium alloy, that has previously been stuck to the printed circuit support 101 and marked in appropriate manner to have the required shape.

In addition, the electro-pyrotechnical head 100 includes two extensive electrically-conductive areas 121 and 122 adjacent to the short sides of the flat strip 110 and of dimensions that are large compared thereto. The current conducting areas 121 and 122 are made so as to cause two conductive tabs to appear adjacent to said flat strip 110. This is done by covering the previously-etched foil of resistive alloy in a metal such as electrolytic copper and then by photoetching. Optionally the metal is subsequently protected by means of a layer of tinning 124.

In addition, as shown in FIGS. 1 and 2, the electro-pyrotechnical head 100 in this case includes parallel current feed pins 102 and 103 that are connected to the two extensive conductive areas 121 and 122 and that extend perpendicularly thereto, through the support 101 and away therefrom. The bonding between the pins 102 and 103 and the two large areas 121 and 122 is implemented by conventional techniques that are well known to the person skilled in the art, e.g. mechanical pressure, crimping, soldering, or any other welding or brazing technique. These pins serve to feed current to the resistive strip via the conductive areas, such that when an electrical current is passed it is only said conductive strip that is heated up by the Joule effect.

It should be observed that the dimensions of the resistive strip 110 and those of the current feed areas 121 and 122 have been determined experimentally after performing a very large number of tests so as to ensure that the initiator has good characteristics of sensitivity and of operating time measured from the beginning of current being passed.

Thus, the resistive strip 110 preferably has a width l lying in the range about 80 micrometers to about 300 micrometers, a length L lying in the range about 0.3 millimeters to about 3 millimeters, and has a rectangular section of thickness e lying in the range about 1 micrometer to about 15 micrometers.

In addition, the conductive areas 121 and 122 are preferably of a shape and a size such as to ensure that the connections they provide are independent relative to the resistive element.

Furthermore, the head 100 includes a thermosensitive substance 104 that is intended to be initiated by the resistive strip heating up under the Joule effect. This thermosensitive substance is in the form of a fine layer of an explosive varnish. It has low mass, having less than 15% of the total mass of the pyrotechnical charge of the initiator. It is constituted by a primary explosive or by a thermosensitive oxidizer-reducer mixture including 2% to 15% of film-generating binder. The explosive varnish is made by mixing said film-generating binder (after being put into solution in an appropriate solvent) with the explosive substances. Using conventional volume or weight measuring means, the mixture is deposited on the resistive flat strip 110 of the printed circuit that constitutes a portion of the initiator head. Thereafter, the varnish solvent is evaporated so as to form an explosive thin layer that is hard and that adheres well.

It should be observed that the nature of the explosive mixture applied in the form of a varnish is defined so as to ensure both hardness and adhesion of the varnish and also so that the thermosensitivity required for the initiator head has a good probability of operating in a short time after current passes through the resistive element 110. In addition, this mixture is defined so that the composition contained in the tank 11 of the cap 10 initiates properly, which composition is generally added in order to reinforce the pyrotechnical initiating or detonating effect of the initiator.

With an igniter, the selected composition is of the oxidizer-reducer type, being constituted, for example, by a mixture of boron and potassium nitrate, or by a mixture of sodium hydride and of potassium perchlorate, or of an equivalent mixture. Such a composition turns out to be easy to ignite using an explosive varnish whose mass is of the order of 5 mg to 10 mg, only.

The film-producing binder that is preferably used should have the following characteristics:

- excellent adhesion to the printed circuit at a dry extract composition that is less than or equal to 10% of the mass of the explosive varnish;
- complete compatibility with the thermosensitive substance, and in particular with the lead styphnate type primary explosives that are generally used; and
- as little inconvenience as possible with respect to igniting the reinforcing composition.

Without being limiting, the above constraints make it preferable for the binder to comprise resins of the cellulose acetate or nitrate type, acrylic polymers or copolymers, or polyvinyl acetate.

We now describe an example of the igniter that illustrates a particular embodiment of the invention in non-limiting manner. It will be observed that the mass of the explosive varnish is selected to ensure that the reinforcing composition will ignite, regardless of temperature, while nevertheless not constituting too great a fraction of the total charge of the igniter, thereby ensuring excellent regularity in the resulting igniting power.

In this example, the igniter comprised a printed circuit whose resistive element was a nichrome strip having a thickness equal to 5 micrometers, a width equal to 100 micrometers, and a length equal to 0.9 millimeters. The resistive strip was deposited on a glass epoxy support of thickness equal to 0.4 millimeters, and it was connected to the current feed pin. After drying, the explosive varnish deposited on the printed circuit had a mass equal to 10 mg and it comprised the following composition by weight:

- 95% lead trinitroresorcinate; and
- 5% of film-generating polymer taken from the family of cellulose esters.

The igniter obtained in that way was covered with a cap whose tank contained 80 mg of a granular ignition composition containing 24% boron and 70% potassium nitrate, with the entire assembly being suitable for sealing relative to the ambient medium by any appropriate means.

The igniter manufactured in that way was tested using known procedures for components of that type and possessed the characteristics given in Table 1.

TABLE 1

| | |
|---|---|
| Resistance between pins | 2 Ω ± 0.2 Ω |
| Operating electrical current at −35° C. (2 ms pulse) Probability of operating: 99.99% | 1.3 A |
| Operating time at ambient temperature (1.5 A pulse over 2 ms) | <1.5 ms |
| Electrical current that fails to ignite at 85° C. (pulse of 10 s) Probability of non-operation: 99.99% | 0.2 A |
| Maximum pressure in a 5 ml can | 40 bars in <3 ms |

The above-described igniter was subjected to the following series of severe cumulative environmental tests:

10 sudden successive thermal shocks from −40° C. to +105° C.;

20 mechanical shocks (in four perpendicular directions) each giving rise to accelerations of 5000 g (i.e. 5000× the acceleration due to gravity);

1 hour of shaking in compliance with the MIL-STD-331B standard ("jolt test"), in each of the four directions; and 2 hours of sinusoidal vibrations at three different frequencies in each of the four directions (giving a total of 24 hours); and these tests were performed in comparison with conventional igniters.

Thereafter the electrical resistances of the two families of igniters were measured and they were tested in closed cans having a volume of 5 $cm^3$. Such cans are provided with respective piezoelectric sensors and with systems for measuring pressure as a function of time. The following results were obtained:

VARIATION BEFORE-AFTER TESTING

| | igniter of the invention | averages of results obtained using conventional prior art igniters |
|---|---|---|
| electrical resistance | 0.00 | +0.05 |
| operating time | −0.09 ms | +2.40 ms |
| time to maximum pressure | −0.01 ms | +2.50 ms |

On examining the above summary of its main characteristics, it can be seen that the initiator of the present invention withstands environmental testing well, whereas that is not true of prior art initiators.

I claim:

1. An electro-pyrotechnical initiator comprising a pyrotechnical charge initiated by a heating resistive element placed in contact with said charge, and designed in particular for igniting the pyrotechnical system of an air bag type device, wherein said resistive element comprises a flat strip of narrow width l, lying in the range 80 micrometers to 300 micrometers, and of length L lying in the range 0.3 mm to 3 mm, the strip being obtained by photoetching a thin film of resistive metal alloy that has a thickness lying in the range 1 μm to 15 μm and that has previously been secured to a printed circuit support, said resistive element being connected to two current feeds via two large electrically-conductive areas, and wherein the pyrotechnical charge is a thermosensitive substance applied in the form of an explosive varnish covering the resistive element.

2. An initiator according to claim 1, wherein said resistive metal alloy is nickel-chromium alloy.

3. An initiator according to claim 1, wherein the resistive flat strip includes two ends in contact with two respective electrically-conductive areas each constituted by a thin layer of conductive metal each conductive area having a shape and a size that ensures it is independent relative to the resistive strip.

4. The electro-pyrotechnical initiator of claim 3, wherein said thin layer of conductive metal is copper.

5. An initiator according to claim 1, wherein the explosive varnish constituting the pyrotechnical charge is a fine adhesive layer having a mass that is less than 15% of the total mass of the pyrotechnical charge, and constituted by a primary explosive having 2% to 15% of a film-generating binder added thereto.

6. An initiator according to claim 1, wherein the printed circuit support is made of a composite plastics material.

7. An initiator according to claim 1, wherein the explosive varnish constituting the initiation charge is a fine adhesive layer having a mass that is less than 15% of the total mass of the pyrotechnical charge, and constituted by a thermosensitive oxidizer-reducer mixture having 2% to 15% of a film-generating binder added thereto.

8. A method of making an electro-pyrotechnical initiator comprising the following successive steps:

causing a thin foil of resistive metal alloy having a thickness in the range of 1–15 micrometers to adhere on a printed circuit support;

photoetching a flat strip in said thin film of alloy masked with a desired pattern, said flat strip having a width in the range of 80–300 micrometers, and a length in the range of 0.3–3 millimeters;

masking said flat strip so as to define two regions of said thin film of resistive metal alloy adjacent to and separated by said flat strip;

covering the two regions of said thin film of resistive metal alloy with a thin layer of electrically conductive metal thereby forming two electrically-conductive areas;

fixing current feeds to each of said conductive areas;

mixing explosive substances with a film-generating binder that has previously been put into solution in an appropriate solvent;

depositing the resulting mixture in the form of a varnish on the resistive flat strip of the printed circuit support; and evaporating the solvent from the varnish so as to form a hard layer of explosive adhering to the resistive flat strip.

9. An initiation system comprising:

an electro-pyrotechnical head comprised of a heat resistive element placed in contact with said charge, wherein said resistive element includes electrically conductive areas adjacent to a flat strip, said flat strip having a thickness in the range of 1–15 micrometers, a width in the range of 80–300 micrometers, and a length in the range of 0.3–3 millimeters, current feeds coupled to each of said conductive areas, and a pyrotechnical charge that is a thermosensitive substance applied in the form of an explosive varnish covering said flat strip; and a cap containing an ignition-reinforcing composition and covering said head in a secure manner.

10. An initiation system comprising:

an electro-pyrotechnical head comprised of a heat resistive element placed in contact with said charge, wherein said resistive element includes electrically conductive areas adjacent to a flat strip, said flat strip having a thickness in the range of 1–15 micrometers, a width in the range of 80–300 micrometers, and a length in the range of 0.3–3 millimeters, current feeds coupled to each of said conductive areas, and a pyrotechnical charge that is a thermosensitive substance applied in the form of an explosive varnish covering said flat strip; and a cap containing a detonation-reinforcing composition, and covering said head in a secure manner.

* * * * *

UNITED STATES PATENT AND TRADEMARK OFFICE

CERTIFICATE OF CORRECTION

PATENT NO. : 5,544,585

DATED : August 13, 1996

INVENTOR(S) : Duguet

It is certified that error appears in the above-identified patent and that said Letters Patent is hereby corrected as shown below:

On the title page, item [57] Abstract, at line 1, please delete " form ".

In column 1 at line 23, please delete " the " and insert -- the form --.

Signed and Sealed this

First Day of July, 1997

Bruce Lehman

*Attest:*

BRUCE LEHMAN

*Attesting Officer*

*Commissioner of Patents and Trademarks*